US006766990B1

(12) United States Patent
Hileman et al.

(10) Patent No.: US 6,766,990 B1
(45) Date of Patent: Jul. 27, 2004

(54) LADDER TOOL HOLDER

(75) Inventors: John Hileman, North Lima, OH (US); Budd R. Brothers, 3857 Fairway Dr., Canfield, OH (US) 44406

(73) Assignee: Budd R. Brothers, Canfield, OH (US)

( * ) Notice: Subject to any disclaimer, the term of this patent is extended or adjusted under 35 U.S.C. 154(b) by 0 days.

(21) Appl. No.: 10/623,454

(22) Filed: Jul. 21, 2003

(51) Int. Cl.[7] ..... E06C 7/14
(52) U.S. Cl. ..... 248/210; 182/129
(58) Field of Search ..... 248/503, 210; 182/129, 211, 27.1, 238, 223.41, 225.41

(56) References Cited

U.S. PATENT DOCUMENTS 2,392,347 A * 1/1946 Walkerq ..... 248/238
3,160,383 A 12/1964 Lamm
4,394,887 A * 7/1983 Spinks ..... 182/214
4,660,794 A 4/1987 Given
4,702,176 A * 10/1987 Goshow ..... 108/9
5,031,723 A 7/1991 Hooten
5,079,795 A * 1/1992 Schmid ..... 15/257.06
5,135,193 A 8/1992 Parris
5,191,954 A 3/1993 Ledford
5,293,957 A 3/1994 Lunden, Jr.
5,649,682 A 7/1997 Martin
5,788,198 A * 8/1998 Sharpe ..... 248/210
5,934,632 A 8/1999 Weaver
5,960,905 A * 10/1999 Gardner ..... 182/129
6,119,317 A * 9/2000 Pfister ..... 24/514
6,131,866 A * 10/2000 Kesinger ..... 248/225.11

* cited by examiner

*Primary Examiner*—Leslie A Braun
*Assistant Examiner*—Amy J. Sterling
(74) *Attorney, Agent, or Firm*—Harpman & Harpman

(57) ABSTRACT

A ladder tool holder for holding hand tools and paint cans on an extension ladder having hollow rungs. The holder comprises a custom metal extrusion member that is registerable within a selected ladder rung. Multiple tool engagement and holding attachments are adjustably keyed into the portion of the extrusion extending from the registration ladder rung.

6 Claims, 7 Drawing Sheets

LADDER TOOL HOLDER

BACKGROUND OF THE INVENTION

1. Technical Field

This invention is related to devices which are adapted to be attached to ladders to provide auxiliary support for equipment, tools and supplies to be used while on the ladder.

2. Description of Prior Art

Prior art devices of this type have been directed to attachments for ladders that utilize the hollow rung of an extension ladder for support such as access trays and brackets used to hold work related items, see for example U.S. Pat. Nos. 3,160,383, 4,660,794, 5,031,723, 5,135,193, 5,181,682, 5,191,954, 5,293,957, 5,649,682 and 5,934,632.

In U.S. Pat. No. 3,160,383 a hanging device is disclosed that extends through the ladder's hollow rung with a paint can hook and support arms extending therefrom.

U.S. Pat. Nos. 4,660,794, 5,031,722, 5,135,193 and 5,191,954 are all directed to trays and platforms that are secured to the ladder using a support rod that extends through the hollow ladder rung.

In U.S. Pat. Nos. 5,191,954 and 5,135,193 secondary support elements engage the ladder's adjacent rungs.

U.S. Pat. No. 5,031,722 discloses a device that extends through the ladder rung providing for a secondary can holding notch on its opposite end.

U.S. Pat. No. 5,181,682 is directed to a tool holder having a bifurcated ladder rung insert that is compressed and inserted into the rung expanding within to hold the tool engagement ring extending therefrom.

U.S. Pat. No. 5,293,957 discloses a container holding attachment which is insertable into a ladder rung having a U-shaped wire insert portion with a sleeve so as to angularly offset within to engage the inner surface of the rung.

U.S. Pat. Nos. 5,649,682 and 5,934,632 claim paint can holders for ladders in which a support arm is inserted into the hollow ladder rung with a can engagement ring extending from its free end. U.S. Pat. No. 5,934,632 has a locking unit that extends from a rung engaging the opposite ladder rail.

SUMMARY OF THE INVENTION

A tool and accessory holder device for ladders with hollow rungs having a universal engagement and support shaft insertable partially into the rung. Multiple tool and utility holders are adjustably secured anywhere along the support shaft's extended portion with a safety ladder engagement locking bracket and registration insert adjustable fittings for interior rung engagement.

DESCRIPTION OF THE PREFERRED EMBODIMENT

Figure 1:
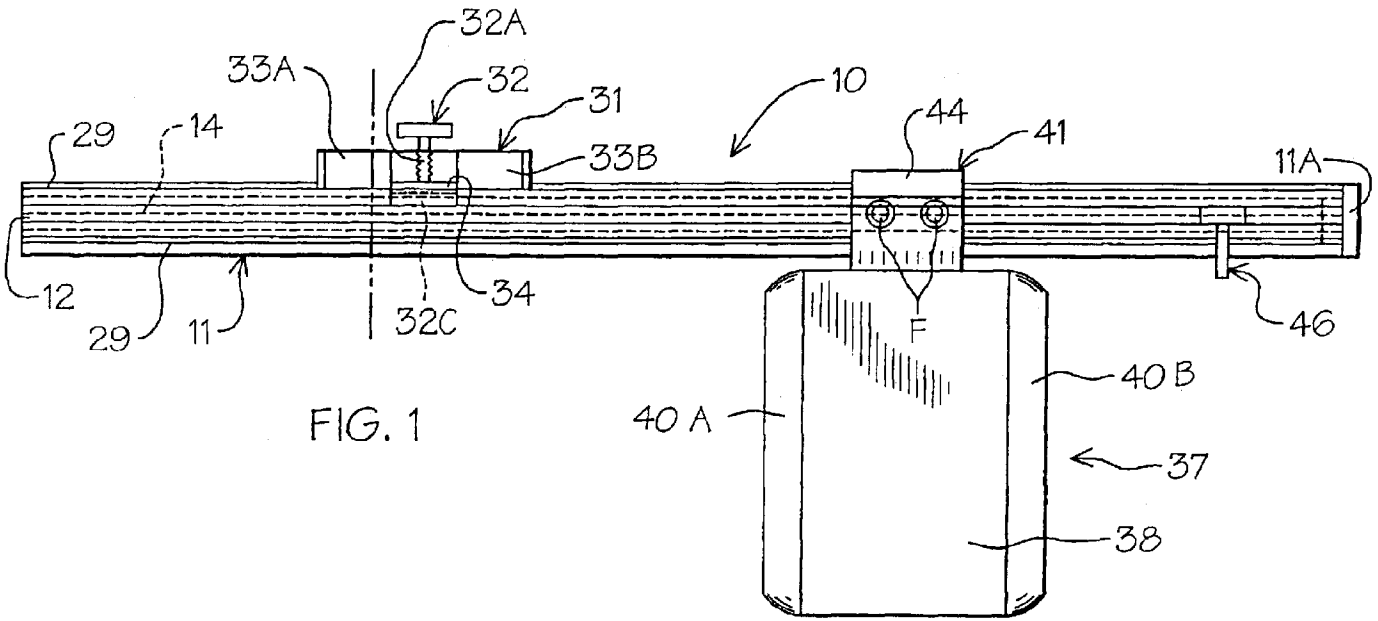
FIG. 1 is a side elevational view of the ladder tool holder of the invention.
Figure 2:
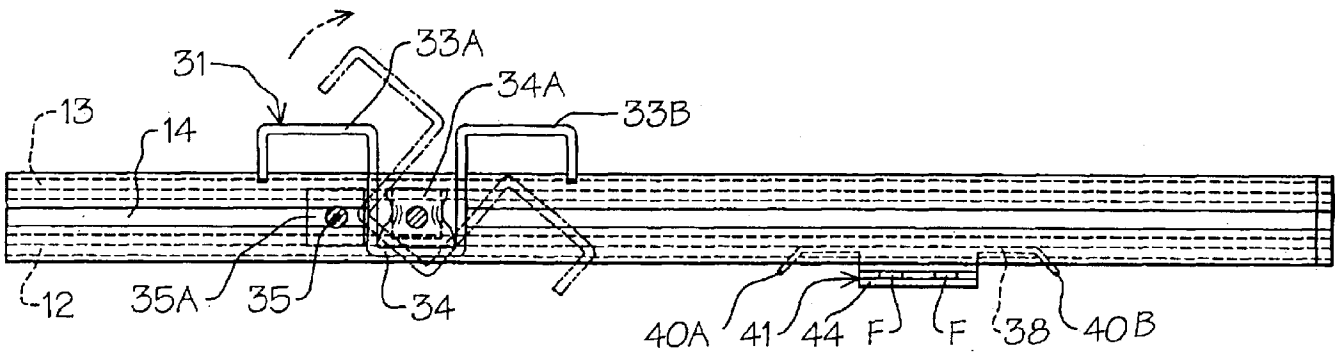
FIG. 2 is a top plan view of the ladder tool holder of the invention as shown in FIG. 1.
Figure 3:
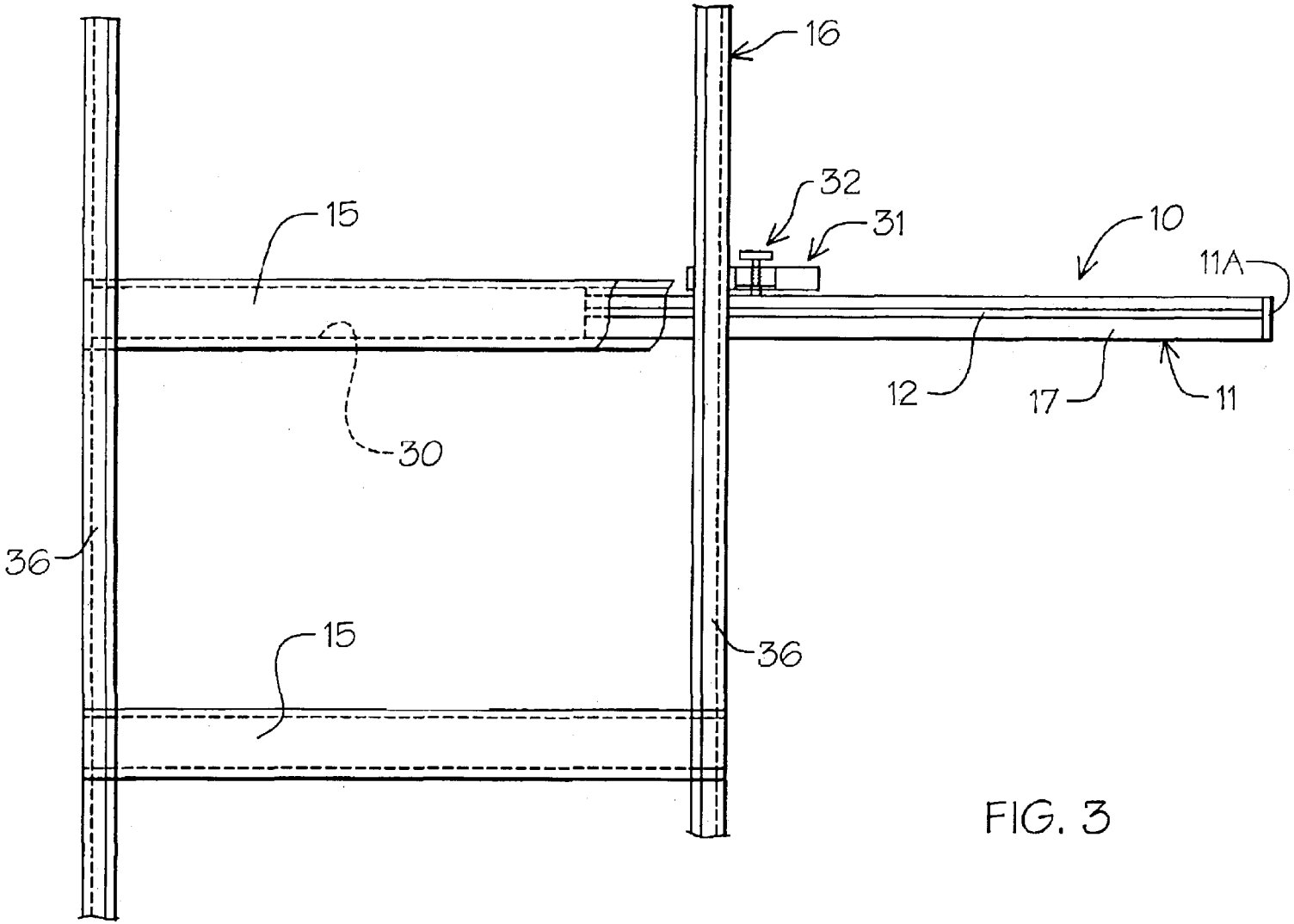
FIG. 3 is an elevational view of the ladder tool holder device of the invention mounted within a ladder with portions broken away for illustration purposes.
Figure 5:
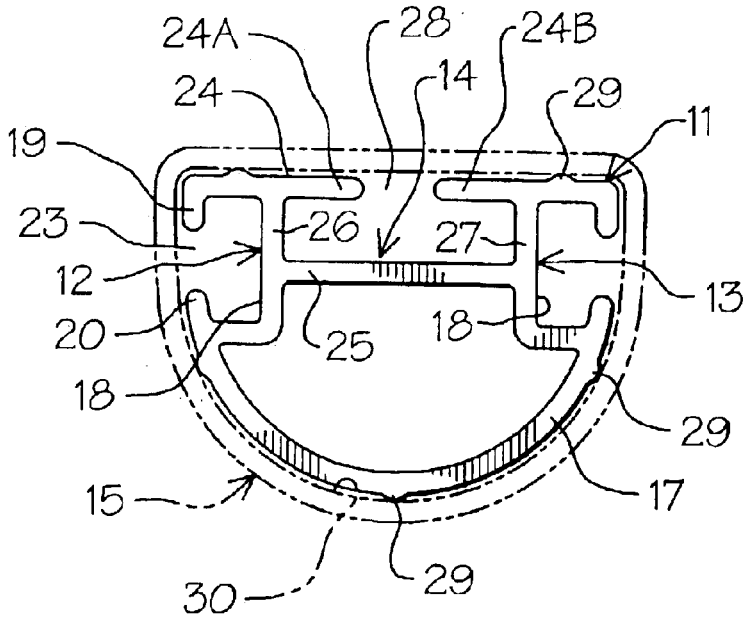
FIG. 5 is an end view of the ladder tool holder's main support and extrusion member within a ladder rung illustrated in broken lines.

Referring now to FIGS. 1, 2 and 5 of the drawings, a tool holder 10 for a ladder can be seen having an elongated extrusion member 11 with multiple engagement side channels 12 and 13 and a top channel 14 within and a closure end cap 11A. The extrusion member 11 is configured to fit within a hollow rung 15 of an extension ladder 16, best seen in FIGS. 3 and 5 of the drawings. The extrusion member 11 has an arcuate lower wall portion 17 which extends to form the respective oppositely disposed side engagement channels 12 and 13. Each of the channels 12 and 13 have a back engagement wall 18 with spaced upper and lower contoured lip portions 19 and 20 with respective access openings at 23 formed therebetween. The top channel 14 is formed within the upper surface 24 of the extrusion member 11 with a bottom wall 25, and integrally upstanding oppositely disposed sidewalls 26 and 27. A channel opening at 28 is formed within the upper surface 24 defining retaining flanges 24A and 24B. It will be noted that the lower wall portion 17 and the upper surface 24 have a plurality of engagement beads 29 extending longitudinally therealong so as to provide multiple points of contact within an interior surface 30 of the hollow ladder rung 15.

A safety retaining clip 31 can be seen as being pivotally secured to the upper surface 24 of the extrusion member 11 by an adjustable threaded fastener assembly 32. The retaining clip 31 has a pair of ladder engagement portions 33A and 33B that are of a generally U-shaped configuration interconnected by a mounting portion 34 having an apertured flange 34A through which the fastener assembly 32 is engaged. The threaded fastener assembly 32 comprises a threaded lock nut knob 32A that extends through the apertured flange 34A and registers with an apertured retaining fitting 32C slidably positioned within the top channel 14 as hereinbefore described.

Figure 7:
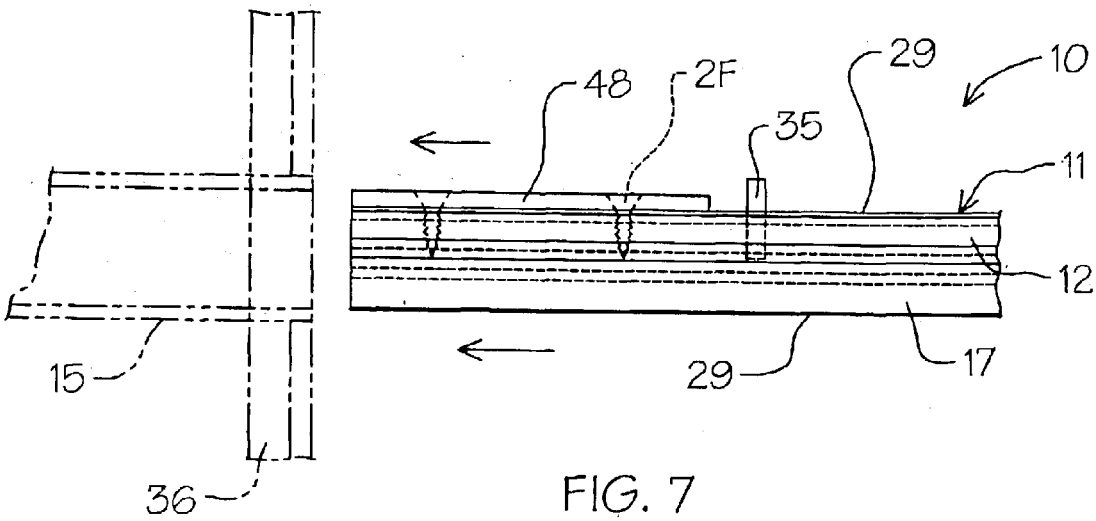
FIG. 7 is a side elevational view of an alternate size insert portion for the ladder tool holder device with a ladder and ladder rung shown in broken lines.
Figure 8:
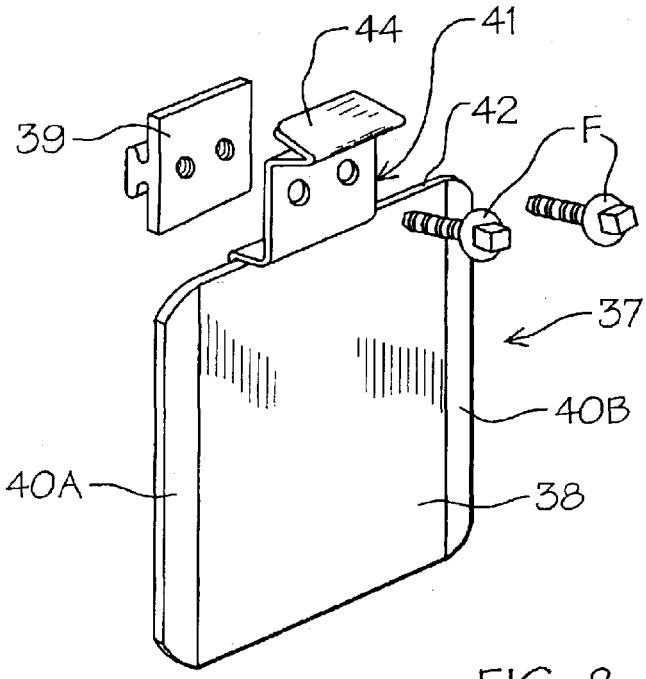
FIG. 8 is a perspective exploded assembly view of a paint can holder accessory and mounting insert.
Figure 10:
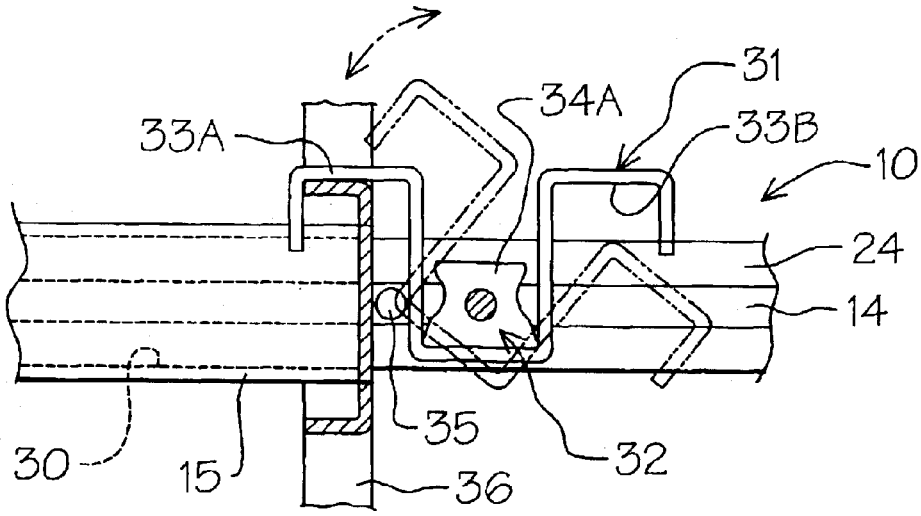
FIG. 10 is a partial top plan view of the ladder tool holder slidably secured within a rung portion of the ladder with the safety retaining bracket engaged thereon.

An engagement stud 35 is threadably secured within the channel 14 by a retaining fitting 35A. The stud 35 will act as a stop for the extrusion 11 during the insertion of same into the hollow rung 15 as best seen in FIGS. 2 and 7 of the drawings.

In use, the extension member 11 is inserted into the selected hollow ladder rung 15 up to the stud 35. The retaining clip 31 is rotatably adjusted about the fastener assembly 32 and is positioned around an adjacent ladder rail 36. The retaining clip 31 acts as a safety retaining device for the extension member 11 which is held by frictional engagement within the ladder rung 15.

Multiple tool engagement fixtures are selectively and adjustably positioned within the extension member 11 by insertion into the respective access mounting slots 12, 13 and 14 as will be described in greater detail hereinafter.

Referring now to FIGS. 1, 2, 4 and 8 of the drawings, an accessory holder 37 for a paint can can be seen having a support plate 38 with a separate mounting insert plate 39 slidably disposed within a selected channel 12. The support plate 38 defines an engagement surface with oppositely disposed angularly extending edge portions 40A and 40B. An angular offset apertured mounting and engagement tab 41 extends integrally from an upper edge surface 42 of the support plate 38. The engagement tab 41 has a contoured handle insert portion 44 that will engage and support a typical handle 45 of a paint can C (as illustrated in broken lines) in FIG. 6 of the drawings. The mounting plate 39 is registerable within the side channel 12 and receives a pair of threaded fasteners F locking the accessory holder 37 in place.

Figure 4:
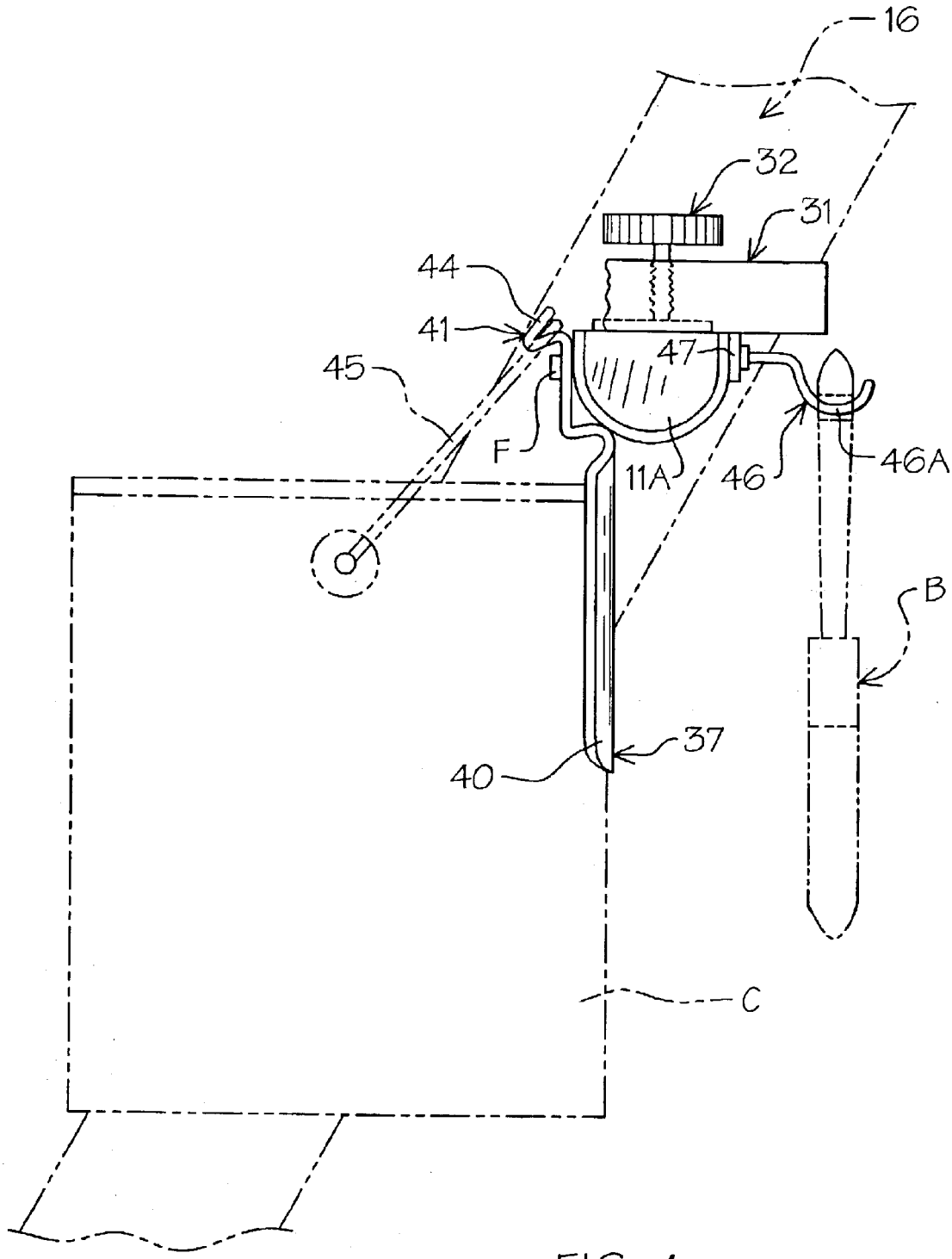
FIG. 4 is an end elevational view of the holder device in use with the ladder and tool accessories for holding a paint can and brush in broken lines.
Figure 6:
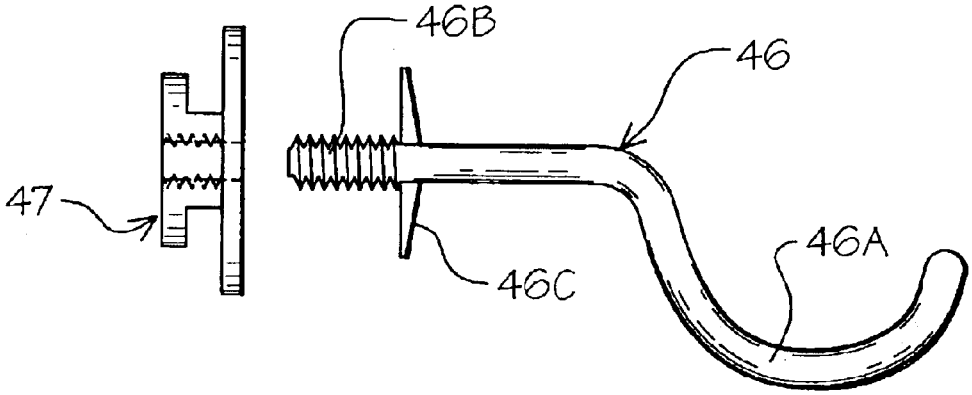
FIG. 6 is a side elevational view of an access hook and insert of the invention.

Referring now to FIGS. 4 and 6 of the drawings, a utility tool hook holder 46 can be seen having a hook portion 46A, a threaded shaft 46B and a retainer 46C portion. A mounting fitting 47 is slidably positioned within one of said selective channels 12 or 13 and threadably receives a hook holder 46 locking it into position with a paint brush B thereon shown in broken lines in FIG. 4 of the drawings.

Figure 9:
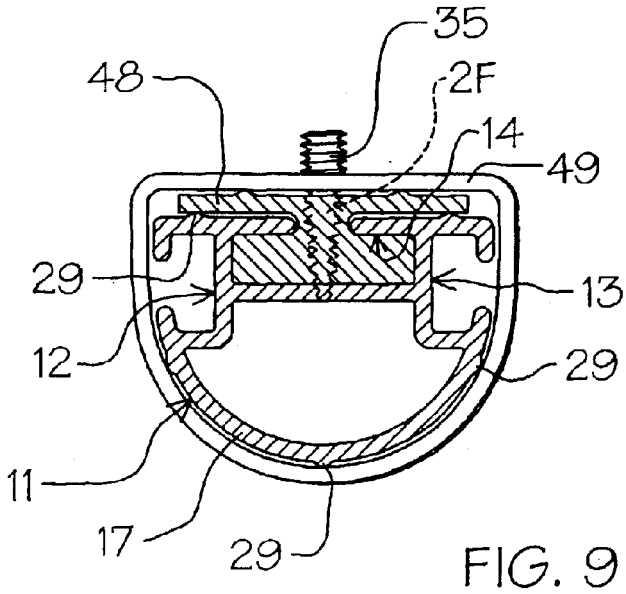
FIG. 9 is a cross-sectional view of the ladder tool holder extrusion member with a size adapter mounted thereon.
Figure 11:
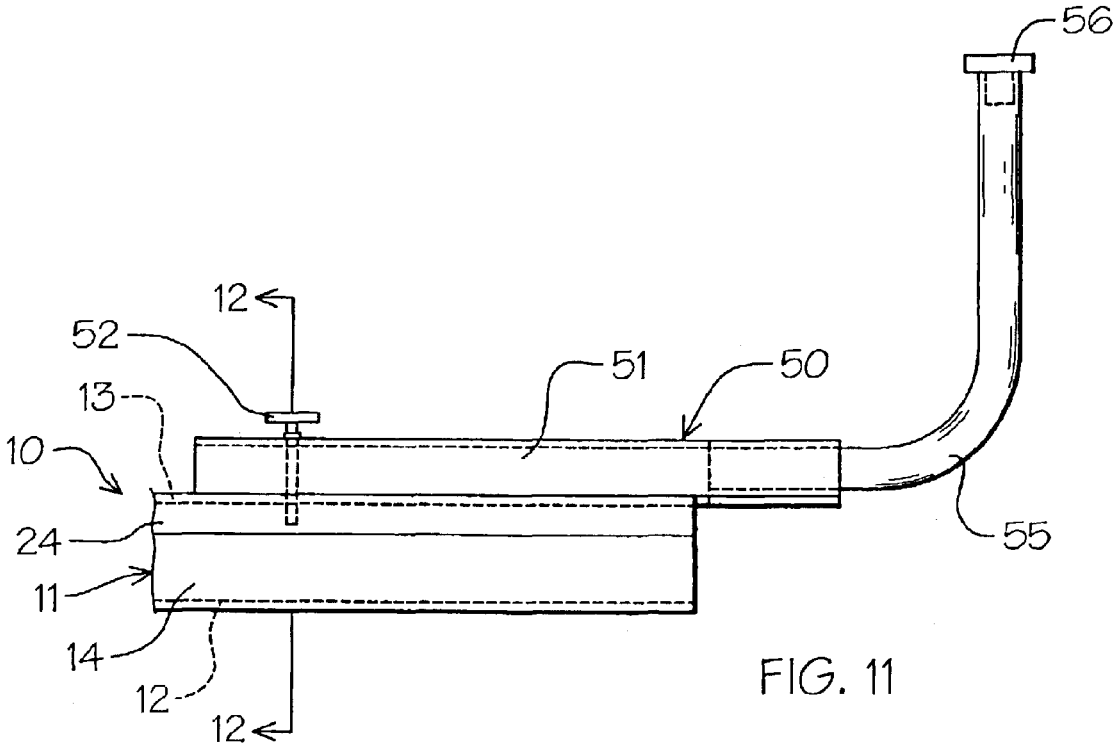
FIG. 11 is a partial top plan view of a ladder stabilizing accessory slidably secured within a portion of the insert member.

Referring to FIGS. 7 and 9 of the drawings, a dimensional adjustment plate 48 can be seen removably positioned by fasteners F within the top channel 14 effectively increasing the overall engagement dimension of the extrusion member 11 so as to be engageable within an alternate ladder rung 49 which is of a larger interior diameter than that of the preferred ladder rung 15 as best seen in FIG. 11 of the drawings.

It will be seen that a variety of tool holder accessories can be added to and supported by the unique multiple channeled configuration of the extrusion member 11 and adjustably positioned thereon.

Figure 12:
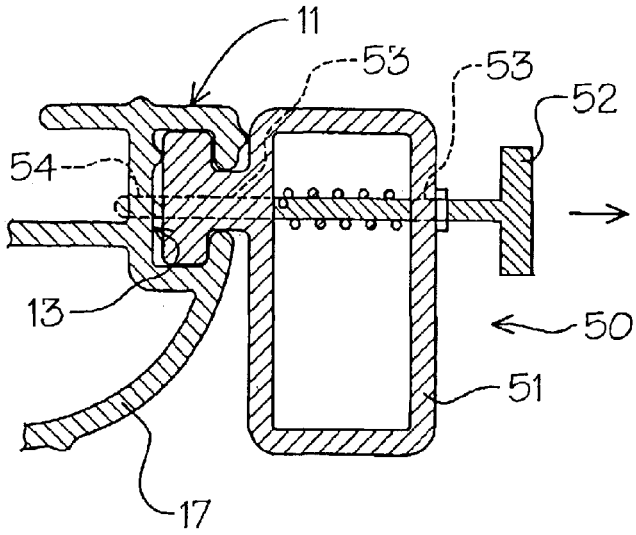
FIG. 12 is an enlarged cross-sectional view of the ladder stabilization extension adapter on the ladder of FIG. 11.

An example of such holder accessories is illustrated in FIGS. 11 and 12 of the drawings wherein a ladder stabilization standoff bracket assembly 50 can be seen having an elongated mounting extrusion 51 that is registerable within the side channel 13 in this example chosen for illustration. A spring urged locking pin 52 extends through aligned apertures at 53 and selectively engages selective apertures 54 in the extrusion member 11. An L-shaped extension member 55 extends from the end of the mounting extrusion 51 having a resilient structure engagement pad insert 56 in its free end as will be well understood by those skilled in the art.

The above description will illustrate that by using a pair of tool holders 10 with attached ladder standoff bracket assemblies 50 the ladder L in use will be held in spaced stabilized engagement against a structure (not shown) as is typical of a ladder standoff device.

It will thus be seen that a new and novel ladder tool holder device has been illustrated and described and it will be apparent to those skilled in the art that various changes and modifications may be made therein without departing from the spirit of the invention.

Therefore we claim:

1. A tool and accessory holder for use on ladders having a plurality of vertically spaced hollow horizontally extending rungs between spaced upright rails comprises;

a. a extrusion member having a transversely flat top surface, contoured depending side surfaces and an arcuate bottom surface, said surfaces of a cross-sectional diameter for a snug insertable fit within a portion of the hollow rung, b. locking means adjustably within said top surface of said extrusion member engageable on one of said ladder rails, said locking means comprising a contoured retaining clip having oppositely disposed U-shaped ladder rail engagement portions, pivotally secured to said channel within the top portion of the extrusion member, c. tool hook holder insert adjustably positioned within engagement sides elongated channel receiving portions of the extrusion member, d. a container retaining and holding assembly slidably disposed and selectively secured to the channel receiving portions of the extrusion member and means for adjustably positioning said rung insert within an alternate dimensional rung.

2. The tool and accessory holder set forth in claim 1 wherein said top and depending side surfaces have respective engagement channels therein.

3. The tool and accessory holder set forth in claim 1 wherein said tool hook holder insert comprises; a threaded tool engagement portion extending from the extrusion member and a threaded receiving retaining fitting slidably disposed within said extrusion member.

4. The tool and accessory holder set forth in claim 1 wherein said locking means further comprises a lock nut knob threadably secured into said extrusion member inwardly from its insertion end.

5. The tool and accessory holder set forth in claim 1 wherein said container retaining and holding assembly comprises, a. an apertured support plate and engagement tab extending from said support plate, b. a mounting insert plate slidably positioned within one channel of said rung insert, c. threaded fasteners extending through said engagement tab and registerably into said mounting block.

6. The tool and accessory holder set forth in claim 1 or 3 wherein said means for adjustably positioning said extrusion member within a alternate ladder rung having an interior dimension greater than that of said ladder rung comprises, an adjustment plate having a contoured insert portion with a spacer portion extending therefrom, said contoured insert portion registerably positioned with said engagement channel in said top surface of said extrusion member.

* * * * *